US005863030A

United States Patent [19]

Kotler et al.

[11] Patent Number: 5,863,030

[45] Date of Patent: Jan. 26, 1999

[54] DASHER BOARD

[75] Inventors: Daniel Kotler, Salt Lake City; David R. Little, Wellsville, both of Utah

[73] Assignee: Dan Kotler, Salt Lake City, Utah

[21] Appl. No.: 802,267

[22] Filed: Feb. 19, 1997

[51] Int. Cl.[6] ..... E04H 17/18

[52] U.S. Cl. ..... 256/24; 256/26; 472/94

[58] Field of Search ..... 256/24, 25, 26, 256/19, 27, 31, 30, 73; 160/135, 229.1; 52/71; 472/92, 94

[56] References Cited

U.S. PATENT DOCUMENTS

| | | | |
|---|---|---|---|
| D. 341,098 | 11/1993 | Yodock . | |
| D. 349,738 | 8/1994 | Naegele, III et al. . | |
| 399,388 | 3/1889 | Dunn | 160/229.1 X |
| 3,266,800 | 8/1966 | Yee . | |
| 3,537,687 | 11/1970 | Adelman . | |
| 3,621,671 | 11/1971 | Ullrich . | |
| 3,727,888 | 4/1973 | Nickolas . | |
| 3,883,120 | 5/1975 | Tippmann . | |
| 3,930,647 | 1/1976 | Berlemont . | |
| 3,986,342 | 10/1976 | MacCracken . | |
| 4,169,688 | 10/1979 | Toshio . | |
| 4,174,096 | 11/1979 | Campbell . | |
| 4,392,647 | 7/1983 | Golebieski . | |
| 4,497,483 | 2/1985 | Ahlgren . | |
| 4,685,656 | 8/1987 | Lee et al. . | |
| 4,773,629 | 9/1988 | Yodock . | |
| 4,880,210 | 11/1989 | Cucksey | 52/71 X |
| 4,883,267 | 11/1989 | Burley . | |
| 4,905,970 | 3/1990 | Holmsten et al. . | |
| 4,927,134 | 5/1990 | Burley . | |
| 4,930,753 | 6/1990 | Alvyn . | |
| 4,946,306 | 8/1990 | Yodock . | |
| 5,035,416 | 7/1991 | Burley . | |
| 5,042,557 | 8/1991 | Norsworthy | 256/73 X |
| 5,087,030 | 2/1992 | Jones . | |
| 5,123,773 | 6/1992 | Yodock . | |
| 5,312,109 | 5/1994 | Cagle . | |
| 5,356,119 | 10/1994 | Schock | 160/135 X |
| 5,402,988 | 4/1995 | Eisele | 256/19 X |
| 5,452,963 | 9/1995 | Christensen . | |
| 5,524,310 | 6/1996 | Farnen . | |
| 5,544,870 | 8/1996 | Kelley et al. | 256/25 X |
| 5,609,327 | 3/1997 | Amidon | 256/19 X |
| 5,706,625 | 1/1998 | Vallance et al. | 472/94 X |

FOREIGN PATENT DOCUMENTS

| | | | |
|---|---|---|---|
| 649629 | 4/1991 | Austria | 256/73 |
| 94604 | 9/1969 | France | 52/71 |
| 2046325 | 11/1980 | United Kingdom | 52/71 |

*Primary Examiner*—Harry C. Kim
*Attorney, Agent, or Firm*—Thorpe, North & Western, L.L.P.

[57] ABSTRACT

A modular containment wall for a sports area. The containment wall is an assembly of panels, each panel having a first edge, an opposing second edge, and interlocking members configured and arranged for (i) interlocking the first edge to a first adjacent panel and (ii) interlocking the second edge to a second adjacent panel. Support legs are rotatably disposed on a back wall of the panels. Each support leg is removably attachable to at least three different attachment sites at the back wall of a panel. The interlocking, modular design of the containment wall enables quick and easy assembly and reassembly, as well as modification to form door ways, sitting areas and similar component structures. In one embodiment, the rear side of the panel includes a recess formed therein. During periods of nonuse, the support leg can be rotated into the recess in a storage position, permitting easy stacking and storage of the panels with the support legs neatly disposed in the rear recesses.

57 Claims, 6 Drawing Sheets

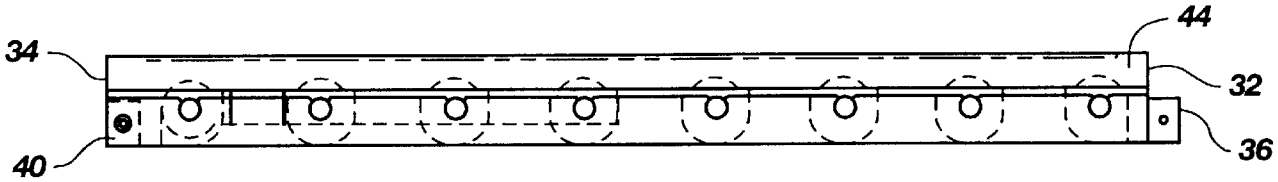
Fig. 2A
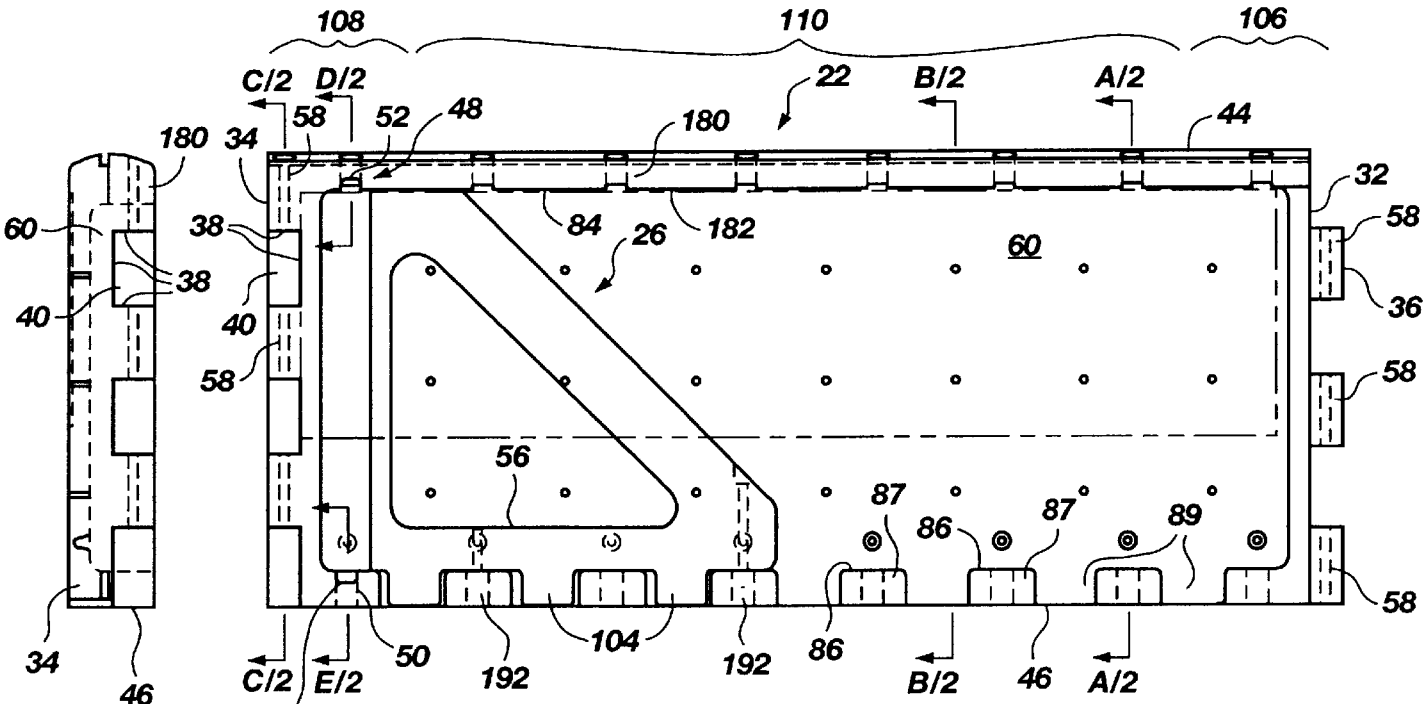
Fig. 2
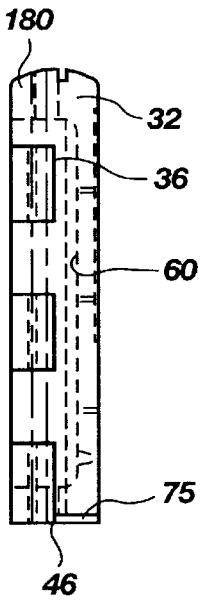
Fig. 2B
Fig. 2C

DASHER BOARD

BACKGROUND OF THE INVENTION

1. The Field of the Invention

The present invention relates generally to modular barrier systems. More particularly, it concerns a modular containment wall enclosure for athletic and other recreational activities.

2. The Background Art

Modular containment walls are known in the recreation industry. Athletic and other recreational activities are enhanced by assembling a modular barrier to serve as a boundary marker, as well as a containment structure in some applications.

Athletic activities, such as indoor soccer, ice hockey, and roller hockey, often take place on multi-purpose fields and surfaces, and it is therefore not feasible to have a containment wall serve as a permanent installation. Instead, the containment wall must often be capable of assembly and disassembly quickly and easily. It is also desirable that interference and modification of the existing landscape be minimized. A further criterion is that the containment wall be sufficiently stable to withstand the impact of pucks, balls, and even players who may be thrust against the wall as part of the activity. The containment wall may also be needed as a crowd control device, and must be sturdy enough in such applications to withstand the press of the crowd.

OBJECTS AND SUMMARY OF THE INVENTION

It is therefore an object of the present invention to provide a containment wall system that is capable of assembly and disassembly quickly and easily.

It is another object of the invention to provide such a containment wall system that is relatively light weight.

It is a further object of the invention to provide such a containment wall system having modular, interchangeable components.

It is an additional object of the invention, in accordance with one aspect thereof, to provide such a containment wall system which is compact.

It is a still further object of the invention, in accordance with one aspect thereof, to provide such a containment wall system having modular wall panels and support legs that are rotatable into a rear recess of the panels in a storage position to enable convenient stacking of the modular panels with the support legs contained in the rear recesses.

The above objects and others not specifically recited are realized in a specific illustrative embodiment of a modular containment wall for a sports area. The containment wall is an assembly of panels, each panel having a first edge, an opposing second edge, and interlocking members configured and arranged for (i) interlocking the first edge to a first adjacent panel and (ii) interlocking the second edge to a second adjacent panel. Support legs are rotatably disposed on a back wall of the panels. Each support leg is removably attachable to at least three different attachment sites at the back wall of a panel. The interlocking, modular design of the containment wall enables quick and easy assembly and reassembly, as well as modification to form door ways, sitting areas and similar component structures. In one embodiment, the rear side of the panel includes a recess formed therein. During periods of nonuse, the support leg can be rotated into the recess in a storage position, permitting easy stacking and storage of the panels with the support legs neatly disposed in the rear recesses.

BRIEF DESCRIPTION OF THE DRAWINGS

The above and other objects, features and advantages of the invention will become apparent from a consideration of the subsequent detailed description presented in connection with the accompanying drawings in which:

FIG. 2 is a rear, side view of a modular, interlockable panel of the containment wall of FIG. 1, with a modular support leg interlocked therewith;

FIG. 2A is a plan view of the panel of FIG. 2;

FIG. 2B is a right-end view of the panel of FIG. 2;

FIG. 2C is a left-end view of the panel of FIG. 2;

DETAILED DESCRIPTION OF PRESENTLY PREFERRED EMBODIMENTS

Figure 1:
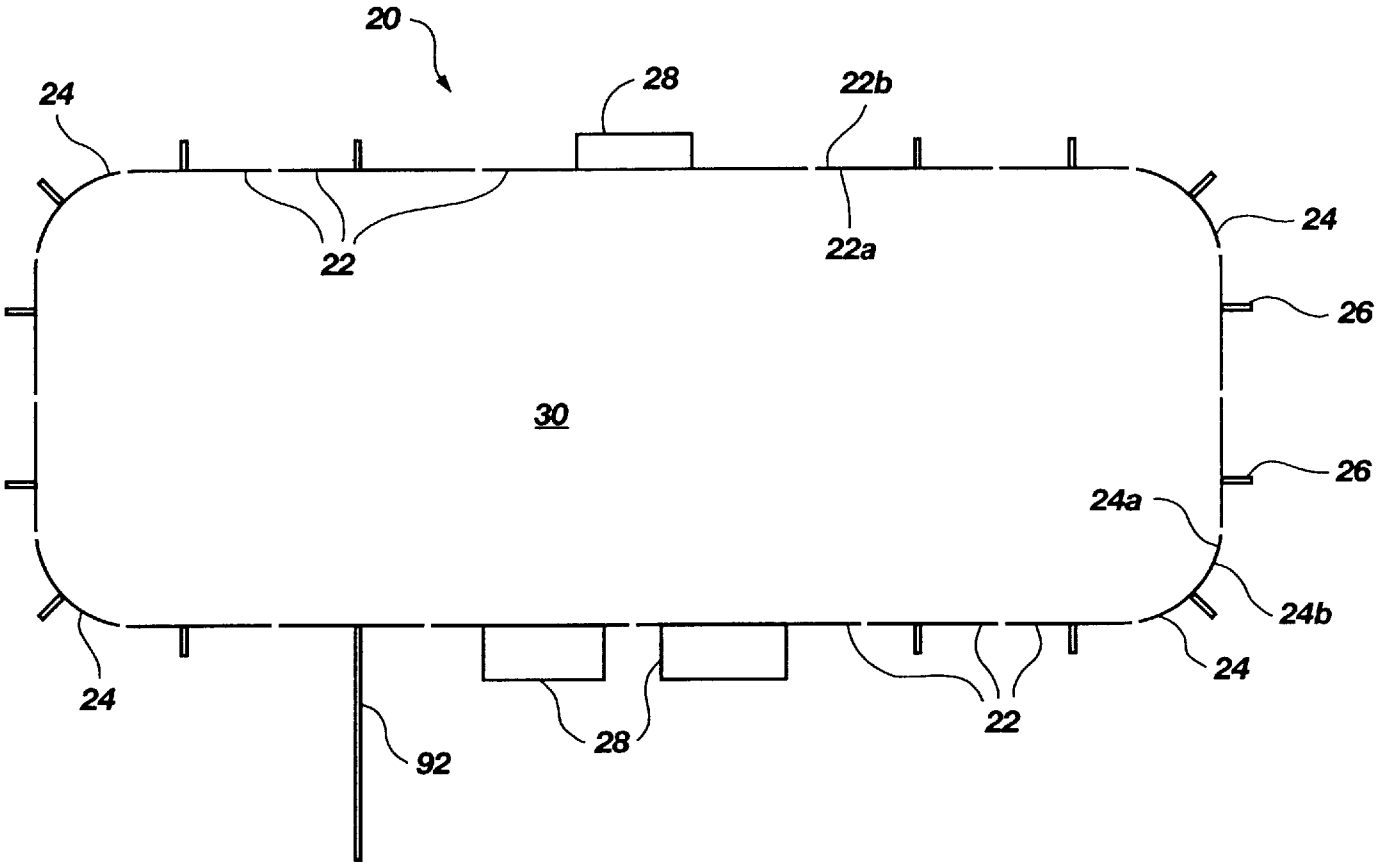
FIG. 1 is a plan view of a modular containment wall, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicants have discovered that a modular, storable containment wall can be constructed that is capable of assembly and disassembly quickly and easily, yet solid and stable when assembled.

Referring now to FIG. 1, there is shown a schematic, plan view of a modular containment wall, designated generally at 20, made in accordance with the principles of the present invention. The containment wall 20 includes an assembly of modular, interlockable panels 22, and corner radius panels shown schematically at 24. The corner radius panels 24 preferably comprise a sequential array of interconnected arcuate panels, but may alternatively comprise a single corner panel having a 90° bend therein. The panels 22 include front walls 22*a* and back walls 22*b*, and the corner radius panels 24 include front and back walls 24*a* and 24*b*.

Support legs 26 are removably attachable at the back walls 22*b* and 24*b* of the panels as shown. Means shown schematically at 28 are also removably attachable to the panels 22 and 24 for performing one of several different functions, including: (i) supporting people in a sitting position; (ii) forming a wall extending laterally outward from the panel; (iii) forming a door; and (iv) forming a room, as shown and described hereafter.

In use, the containment wall 20 is quickly assemblable to operate as a temporary wall as shown in FIG. 1. Users simply interlock the panels 22 and 24 together, and removably attach the support legs 26 at the back walls 22*b* and 24*b* of the panels to provide a stable containment wall configuration, as described below in more detail. The containment wall 20 can be used for at least partially enclosing, and preferably fully enclosing, lateral bounds of a sports area 30.

Figure 3:
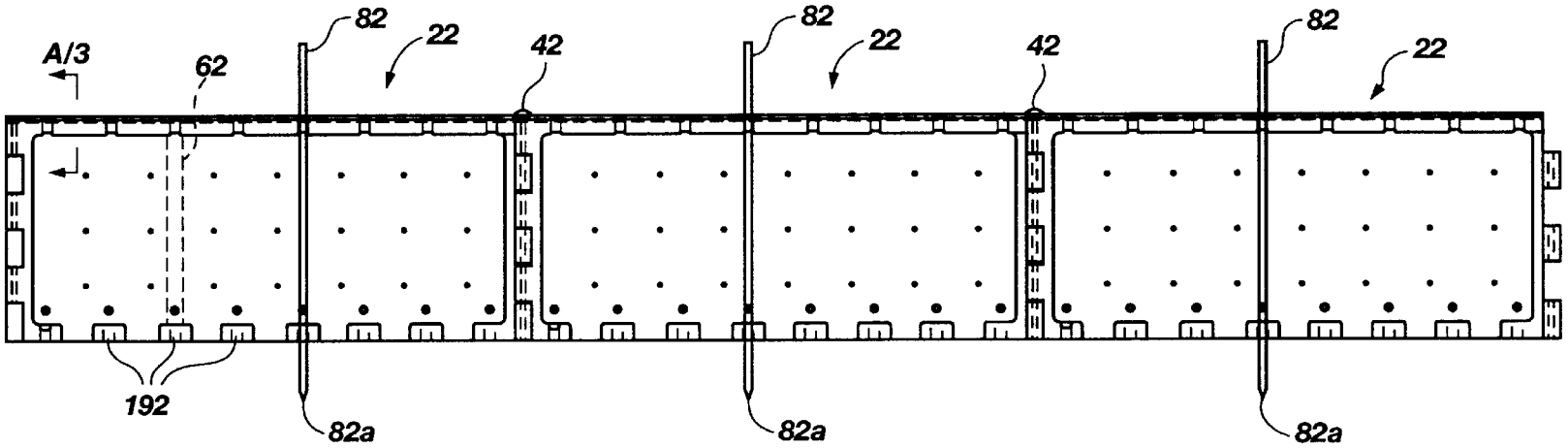
FIG. 3 is a rear, side view of a plurality of modular panels of the containment wall of FIG. 1, shown in an interlocked orientation with one another as adjacent panels.

Referring now to FIGS. 2–3, some of the more particular structural aspects of the present invention are shown. Each panel 22 has a first end wall 32 and an opposing second end wall 34, as well as a top wall 44 and a bottom wall 46 coupled between the opposing first and second end walls to form a substantially continuous panel perimeter. The front and back walls 22*a* and 22*b* are coupled at opposing front and back edges of the panel perimeter as shown.

A plurality of pairs of vertically spaced upper and lower leg mount means 48 and 50 are formed respectively at upper and lower locations on the panels 22 as shown, for enabling removable attachment of the support leg 26 at the back wall 22*b* of the panel 22. The support leg 26 includes upper and lower end nubs 52 and 54 that are removably attachable at the upper and lower leg mount means 48 and 50, respectively. The support leg 26 further includes a lateral support member 56.

The panels 22 further comprise coupling means for coupling the first end walls 32 with the second end walls 34 of the panels 22 and 24 in an end-to-end, abutting manner. The coupling means preferably comprise a plurality of projecting interlock members 36 extending laterally outwardly from the first end wall 32 in a vertically spaced apart orientation, and recessed walls 38 defining a plurality of enclosures 40 in the second end walls 34 of at least some of the panels 22 for receiving the projecting interlock members 36 into said enclosures 40.

The coupling means further comprise support rods 42 (FIG. 3). The projecting interlock members 36, the recessed walls 38 defining the enclosures 40, and the top walls 44 of the panels 22 and 24 have throughpassages 58 formed therein. The throughpassages 58 formed in the projecting interlock members 36 and recessed walls 38 are disposed in substantial axial alignment with each other and with throughpassages 58 in the top walls 44 of the panels 22 and 24 when the projecting interlock members 36 are received into the enclosures 40 such that the axially aligned throughpassages 58 collectively define a single throughpassage for receiving a support rod 42 therethrough.

Accordingly, the support rod 42 operates as a security member which prevents separation of the adjacently attached panels 22. The conventional modular containment walls known to applicants comprise panels that are not physically locked together in such a solid manner. Although the prior art modular containment walls do have interlocking capacity to some extent, a large enough impact force can dislodge and separate adjacent panels without deforming the physical structure, whereas the present invention involves the locking support rods 42 which prevent separation of adjacent panels 22.

The coupling means, whether in the form of the interlock member 36 and enclosures 40 or in some other form, preferably comprise means for coupling the first end walls 32 with the second end walls 34 in a manner such that a substantially continuous surface is formed between adjacent panels 22.

Regarding the leg mount means 48 and 50, they collectively comprise means for removably attaching the support leg 26 to at least three different attachment sites on one of the panels 22 or 24, by virtue of there being preferably several sets of leg mount means 48 and 50 formed at the back wall 22*b* or 24*b* of the panels 22 or 24. Stated another way, each panel 22 comprises a first end section 106, an opposing second end section 108, and an intermediate section 110, such that the support leg 26 is removable attachable at either the first end section 106, second end section 108, or intermediate section 110. As shown most clearly in FIG. 4, the feet 104 comprise a plurality of downward projecting support elements alternating with spacial gaps 112 therebetween. The back wall 22*b* of the panel 22 includes a plurality of lower recessed walls 86 defined by rearward projecting elements 87 alternating with spacial gaps 89 therebetween, the spacial gaps 89 being aligned to receive downward projecting support elements 104 of a lateral support member 56 of the leg 26 when said leg is in the storage position (shown most clearly in FIG. 2).

Figure 4B:
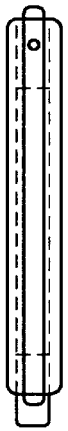
FIG. 4B is right-end view of the panel of FIG. 4.
Figure 4A:
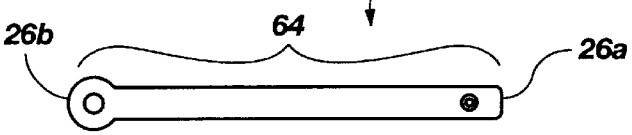
FIG. 4A is a plan view of the support leg of FIG. 4.
Figure 4:
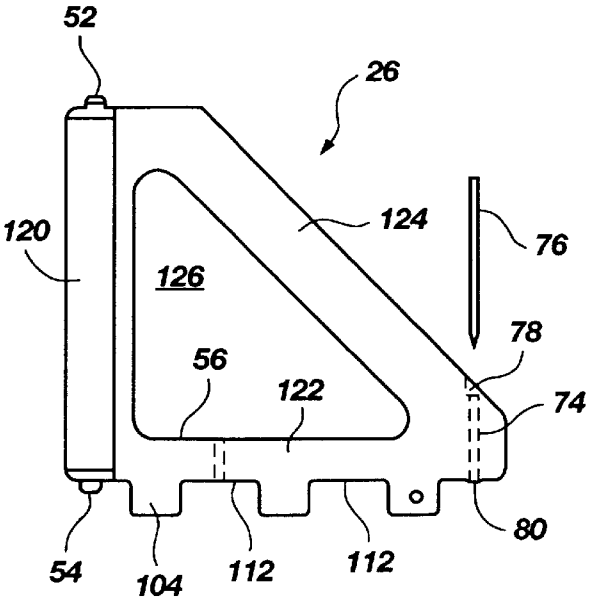
FIG. 4 is a side view of the modular support leg shown in FIG. 2.

The support leg 26 preferably comprises a three-sided, substantially triangular-shaped member as shown in FIGS. 2 and 4. More particularly, the leg 26 includes first, second and third support arms 120, 122 and 124 intercoupled in series to form a three-sided member defining a substantially triangular central opening 126. The first support arm 120 is vertically disposed when the support leg 26 is attached at the upper and lower leg mount means 48 and 50. The vertically disposed support arm 120 includes the upper nub 52 and an opposing lower nub 54 formed thereon for insertion into the upper and lower leg mount means 48 and 50, respectively. The second and third support arms 122 and 124 are horizontally and diagonally disposed, respectively, when the support leg 26 is attached at the upper and lower leg mount means 48 and 50 (shown most clearly in FIG. 2).

One of the key aspects of the invention is the provision of an exterior recess 60 formed in the back wall 22*b* for receiving the support leg 26 thereinto into a storage position as shown in FIG. 2. The recess 60 thus includes a vertical span that is longer than the support leg 26 in order to receive the support leg 26 thereinto. Accordingly, the upper and lower leg mount means 48 and 50 comprise means for (i) movably attaching the support leg 26 to the back wall 22*b* and (ii) enabling movement of the support leg 26 from a first, lateral position (as in FIG. 1) to a second, storage position (as in FIG. 2) such that said support leg 26 resides in said recess 60 when disposed in the second, storage position (as in FIG. 2).

Referring now to FIGS. 3–4, one aspect of storing the support leg 26 in the exterior recess 60 is enhanced by the shape of the support leg 26. More specifically, the support leg 26 includes a semicylindrical end 26*b* which fits neatly with a vertical, semicylindrical indentation 62 formed in the rear of the panels 22. A horizontal cross section taken from the support leg 26 defines a first, elongate portion 26*a* having a substantial rectangular shape, to which the semicylindrical end 26*b* is coupled. The semicylindrical end 26*b* has a circular shape defining an outer diameter, and the first, elongate portion 26*a* is narrower than said outer diameter. This structural configuration permits contiguous contact of substantially an entire sideface 64 against the back wall 22*b* while preserving rotatability of the support leg 26 as it resides in alignment within its upper and lower leg mount means 48 and 50.

The configuration of semicylindrical end 26*b* and the vertical, semicylindrical indentation 62 significantly increases the surface area contact between the panel 22 and the support leg 26. As such, an enhanced force distribution occurs between the panel 22 and support leg 26, thereby reducing wear upon the support leg 26 when impact forces of athletic play are imposed upon the panel 22 and transmitted into the support leg 26. Such impact forces are transmitted across a greater surface area when compared to a rounded end 26*b* that disposed against a planer surface instead of against the semicylindrical indentation 62.

Preferably, the exterior recess 60 is recessed sufficiently deep to receive the support leg 26 completely within the compartment when said leg is rotated to the storage position (as in FIG. 2) to facilitate a stable stacking configuration wherein the front wall 22*a* of each panel 22 rests flat on top of the back wall 22*b* of an adjacent, stacked panel 22.

A further optional but preferred aspect of the support leg 26 includes provision of a plurality of lateral support members, or feet, 104, disposed in a horizontally extending orientation and at a common level with and laterally displaced from the bottom wall 46 of the panel 22 when the support leg is attached at the upper and lower leg mount means 48 and 50, as shown most clearly in FIG. 2.

Referring now to FIGS. 5A–5E, the structure of each panel 22 has several novel aspects thereto. The panels 22 are hollow, and the front wall 22*a* and back wall 22*b* are disposed in a spaced-apart orientation as shown. The panel 22 preferably comprises a fluidic inner layer 70, such as air, that is disposed between the front wall 22*a* and back wall 22*b*. The panels 22 also preferably comprise internal bracing means for bracing the front wall 22*a* and back wall 22*b* with respect to each other, the internal bracing means preferably comprising a plurality of spaced-apart brace members 72 sandwiched between the front wall 22*a* and back wall 22*b*. The brace members 72 preferably include throughpassages 72*a* formed therein extending through the front wall 22*a* and back wall 22*b*.

Figure 5D:
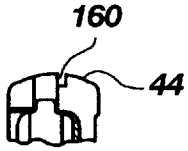
FIGS. 5D–5E collectively comprise a side, break away cross-sectional view of the panel of FIG. 2, taken along sections D/2 ad E/2, respectively.
Figure 5E:
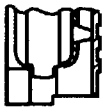
Figure 5A:
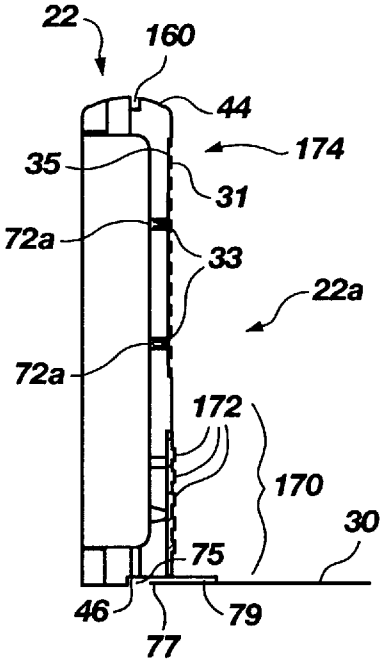
FIG. 5A is a side, cross-sectional view of the panel of FIG. 2, taken along section A/2.

The throughpassages 72*a* provide several important advantages, including wind relief, venting and accommodating the attachment of external items such as signs and ad boards (or any suitable information plate). The effect of a large gust of wind which might lift or otherwise displace the panels 22 is greatly dissipated by the throughpassages 72*a* which permit portions of the wind to pass directly through the panels 22. Regarding the placement of signs or advertising boards, FIG. 5A illustrates a phantom line depiction of an ad board 31 having engagement fingers 33 disposed thereon for convenient insertion into the throughpassages 72*a*. The throughpassages 72*a* are therefore large enough to accommodate inserted pieces such as items 33, but are also preferably small enough to prevent insertion thereinto of a human finger, such that inadvertent capture of a player's finger is avoided.

Figure 5B:
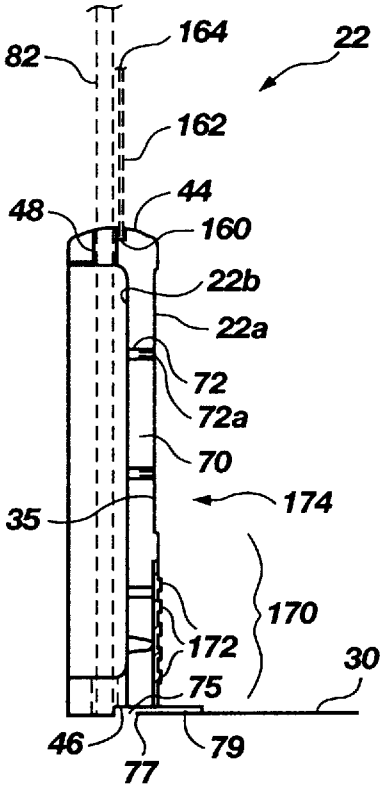
FIG. 5B is a side, cross-sectional view of the panel of FIG. 2, taken along section B/2.
Figure 5C:
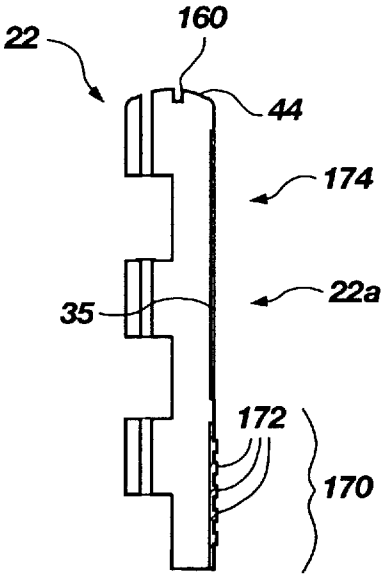
FIG. 5C is a side, cross-sectional view of the panel of FIG. 2, taken along section C/2.

FIGS. 5A–5C illustrate a preferred embodiment of the front wall 22*a* to include a recess portion 35 for receiving thereinto the sign or ad board 31 (shown in phantom line in FIG. 5A). The recess portion 36 enables placement of signs and ad boards thereinto which hides the perimeter edges of the ad boards and thereby inhibits inadvertent contact therewith.

The support leg 26 preferably includes a downward oriented anchor opening 74 in a vertical plane of the leg. The anchor opening 74 operates as a throughpassage and is thus configured for insertion of an anchor member 76 therethrough and into a subfloor or ground surface. The anchor opening 74 is vertically disposed when the support leg 26 is attached at the upper and lower leg mount means 48 and 50, and includes an upper opening 78 and an opposing lower opening 80. As such, the anchor member 76 operates as a means for (i) inserting into the upper opening 78 of the anchor opening 74, (ii) extending from the lower opening 80, and (iii) anchoring the support leg 26 to a support means.

It is preferred that the upper and lower leg mount means 48 and 50 constitute throughpassages formed in the top walls 44 and bottom walls 46, respectively, preferably disposed in substantial axial alignment. This configuration accommodates the dual function of enabling rotational attachment of the support leg 26, as well as passage of support rods 82 through leg mount means 48 and 50 that are not being used to attach the support leg 26. The invention further comprises anchoring means for anchoring the support rods 82 to ground or subflooring residing beneath the panels 22; such anchoring means may simply comprise pointed distal ends 82*a* of the rods 82, or any other suitable means known to those or ordinary skill in the field for anchoring the rods in any manner desired. The throughpassages formed in the leg mount means 48 and 50 preferably, respectively comprise upper support channels sandwiched between an upper recessed wall 84 and the top wall 44, and lower support channels sandwiched between a lower recessed wall (or plurality of walls) 86 and the bottom wall 46.

Figure 7:
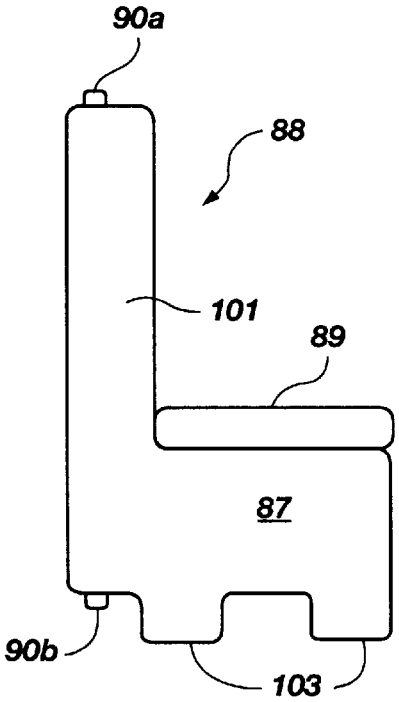
FIG. 7 is a side view of a modular bench member that is interlockable with the modular panel of FIG. 2.

The invention may further include a means removably attachable to the panels 22 for performing a function selected from the group consisting of:

(i) supporting people in a sitting position, a function performed by a removably attachable bench 88 (see FIG. 7); the bench 88 includes upper and lower nubs 90*a* and 90*b* that are insertable into the upper and lower leg mount means 48 and 50;

(ii) forming a wall 92 (see FIG. 1) extending laterally outward from the panels 22, the wall 92 being removably attachable to the panels 22 in a manner similar to that of the bench 88 of FIG. 7;

(iii) forming a door 94 (see FIG. 8) preferably having a plurality of vertically spaced apart fingers 96 that are engageable between similarly spaced fingers 98 formed on a wall section, the fingers all including throughpassages 100 formed therein for receiving a hinge pin 102 therethrough; and (iv) forming a room 28 (see FIG. 1), for use as a penalty box during hockey play, for example.

The bench 88 includes a seat member 87 having a horizontal seat surface 89. A seat support member 101 is coupled to the seat member 87, and at least one lateral support member 103 horizontally positioned at a common level with and laterally displaced from the bottom wall 46 of the panel 22, when attached, to provide additional stability to the panels and loading support for the seat member.

Figure 8:
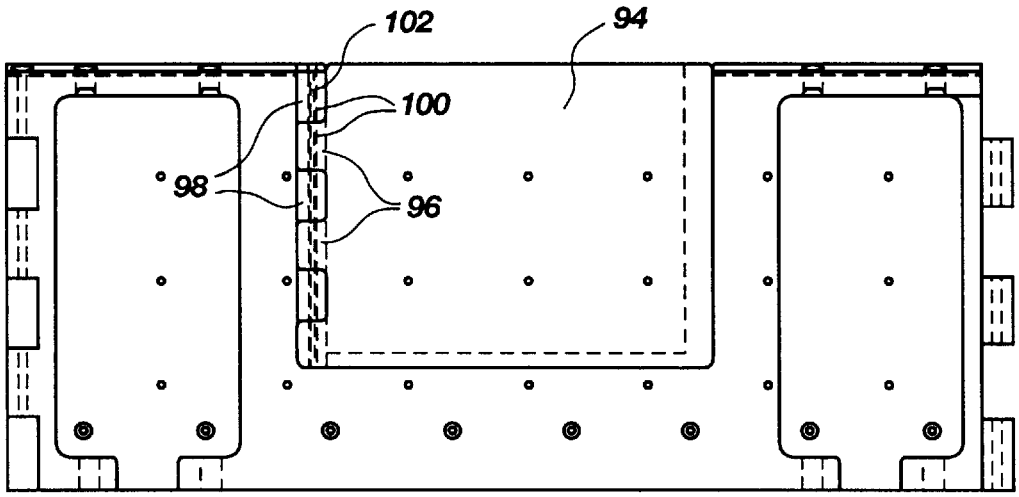
FIG. 8 is a rear, side view of an alternative embodiment of the modular panel of FIG. 2, including a modular door member interlocked therewith.
Figure 9:
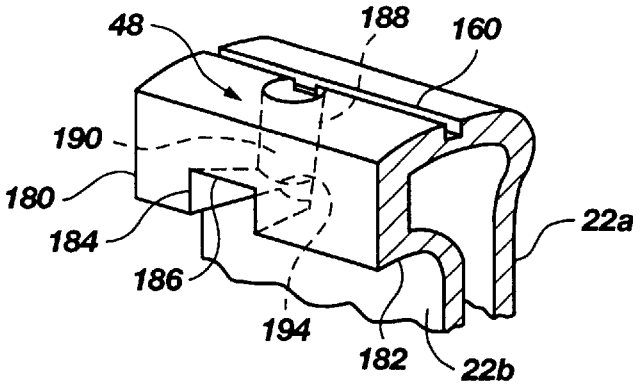
FIG. 9 is an enlarged side, cross-sectional, breakaway view of one of the panels of FIG. 3, taken along section A/3, showing structural detail of an upper entry slot formed in the panel.
Figure 11:
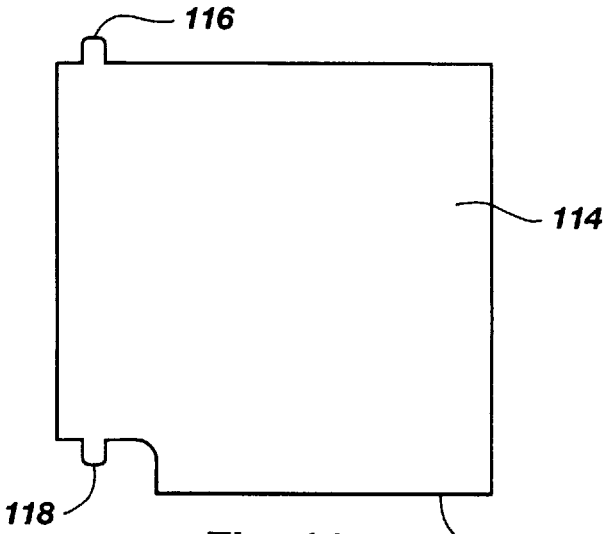
FIG. 11 is an alternative embodiment of the modular door member shown in FIG. 8.

As an alternative to the door 94 depicted in FIG. 8 is shown in FIG. 11. A door member 114 may be designed for attachment to the upper and lower leg mount means 48 and 50 in a manner similar to the way the rotational support leg 26 is attached, by provision of an upper nub 116 and an opposing lower nub 118 formed thereon. The door member 114 preferably includes a bottom wall 120 that is horizontally positioned at a common level with and laterally displaced from the bottom wall 46 of the panel 22, when the door member 114 is rotatably attached to the upper and lower leg mount means 48 and 50.

Figure 10A:
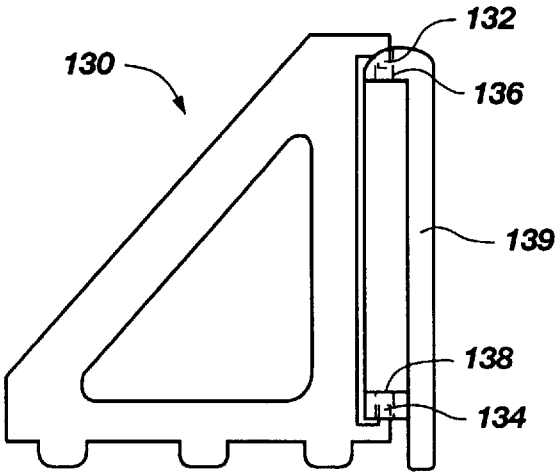
FIG. 10A is a side view of an alternative embodiment of the modular, interlockable panel and modular, interlocked support leg of FIG. 4.
Figure 10B:
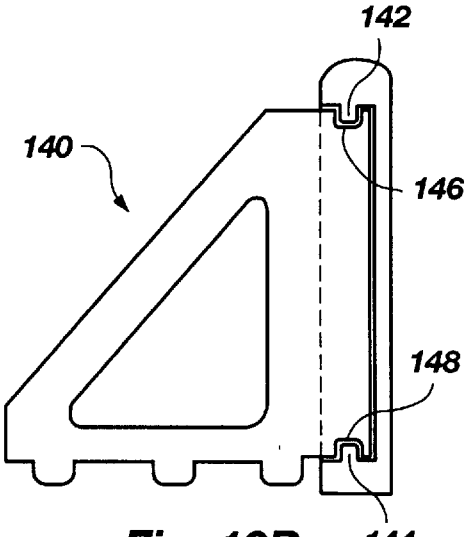
FIG. 10B is a side view of another alternative embodiment of the modular, interlockable panel and modular, interlocked support leg of FIG. 4.

Referring now to FIGS. 10A–10B, there are shown alternative embodiments of the support leg 26. In FIG. 10A, there is shown a support leg, designated generally at 130 having an upper, downwardly extending nub 132 and a lower, upwardly extending nub 134 disposed on upper and lower ends, respectively, of the support leg 130. The upper and lower nubs 132 and 134 are positioned, aligned and arranged for simultaneously extending into upper and lower receiving channels 136 and 138, respectively, of an alternatively designed panel 139.

In FIG. 10B, there is shown a further alternative support leg, designated generally at 140. This support leg 140 is accommodated by alternative upper and lower leg mount means comprising a downwardly extending nub 142 and an upwardly extending nub 144, respectively. Upper and lower ends of the support leg 140 include receiving slots 146 and 148, respectively, said slots 146 and 148 being positioned, aligned and arranged for simultaneously receiving the downwardly and upwardly extending nubs 142 and 144, respectively.

Figure 6:
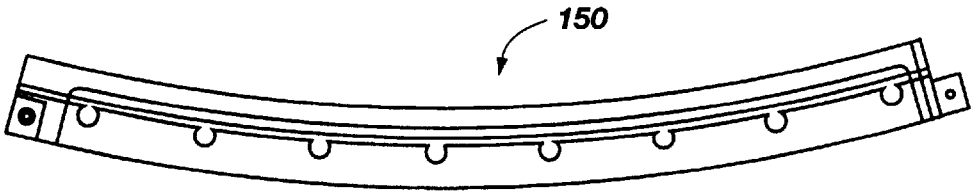
FIG. 6 is a plan view of a modular, interlockable, corner radius panel of the containment wall of FIG. 1.

Referring now to FIGS. 1 and 6, some the panels 24 preferably comprise a panel 150 defining an arcuate shape sufficient in dimension and configuration to enable all panels 22 and 150 to be sequentially intercoupled by coupling means in an endless boundary enclosure surrounding the sports area, such that at least a first portion and a second portion of said boundary enclosure define a 90° angle therebetween.

Referring now to FIG. 2A, FIGS. 5A–5D and FIG. 9, the top wall 44 of at least some of the panels 22 includes an elongate slot 160 formed therein for receiving a backstop panel 162 thereinto. The upper leg mount means 48 would comprise top throughpassages formed for receiving the support rods 82 therethrough, said top throughpassages having inner diameters, wherein the elongate slot 160 defines a rear plane and wherein a gap space 164 resides between said rear plane of the slot 162 and the inner diameters of the top throughpassages 48, such that when support rods 82 are disposed to extend upwardly from the top throughpassages 48 and when a backstop panel 162 resides in said elongate slot 160, said backstop panel 162 and said support rods 82 define gap spaces 164 therebetween. If desired, the slot 160 may be formed to intercept the top throughpassages 48, and thereby be disposed in communication with said top throughpassages.

The significance of the gap space 164 resides in the impact noise generated when a hockey player, for example, is thrust against the backstop 162 as part of the hockey competition. Applicants have found a broader user appeal for hockey field containment walls that produce a louder noise upon impact by a hockey player. Providing the gap space 164 between the backstop 162 and the support rods 82 increases the desired impact noise and the thrill of the athletic contest.

Referring now to FIGS. 5A–5C, the front walls 24*a* of the panels 22 comprise a lower portion 170 having a plurality of outwardly projecting, spaced-apart ribs 172 for enhanced resistance to external forces applied to said lower portion 170. The projecting ribs 172 extend horizontally and thus in a first direction toward the first end wall 32 and in a second direction toward the second end wall 34. Further, the lower portion 170 of the front wall 22*a* is preferably thicker than an upper portion 174 for enhanced wear resistance of said front wall 22*a*.

The projecting ribs 172 thus provide an alternating structural variation which significantly enhances the strength of the lower portion 170 regardless of whether the lower portion is thicker. The projecting ribs 172 themselves provide enhanced structural strength, thereby increasing the capacity of the panels 22 to withstand the impact force of flying pucks, skates, player's feet and the like.

Referring now to FIGS. 2B and 5A–5B, the lower portion 170 of at least some of the front walls 24*a* preferably include a lateral slot 75 formed therein for receiving an edge 77 of a tile 79 thereinto, said lateral slot being defined by a portion of the bottom wall 46. More specifically, the portion of the bottom wall 46 defining the lateral slot 75 is coupled to the front wall 22*a* such that said front wall 22*a* resides above said lateral slot 75 and thus out of direct contact with the sports area 30. The advantage provided thereby is that the slot 75 will accommodate expansion and contraction movement of the tile 79, as well as tile movement generated for other reasons. Many athletic field applications utilize interlocking sports tiles 79 for covering the sports area 30. By forming the lateral slot 75 in the panels 22, lateral movement of the tiles 79 toward or away from the panels 22 is accommodated to prevent buckling of the tiles 79.

Referring now to FIGS. 2 and 2A–2C and FIG. 9, it is preferred that the back wall 22*b* of at least some of the panels 22 comprises an upper, rearwardly extending ledge 180 having an underside 182. The upper leg mount means 48 preferably comprises a lateral entry slot 184 formed in the underside 182 of the ledge, said entry slot 184 extending toward the front wall 22*a* and having an upper side 186. The upper leg mount means 48 further comprises vertical side walls 188 defining an upper vertical channel 190 disposed in communication with the entry slot 184. The upper side 186 of the lateral entry slot 184 preferably tapers downwardly in a direction toward the front wall 22*a* such that said upper side 186 defines an acute angle with respect to the vertical side walls 188.

This structural configuration enables a more convenient insertability of the support leg 26 (or bench 88 or door 114) into the upper and lower leg mount means 48 and 50, explainable as follows. The lower leg mount means 50 preferably comprises a plurality of rearward projecting elements (or feet) 87 having lower vertical channels 192 formed therein. It will be appreciated that a vertical span defined by the upper and lower end nubs 52 and 54 of the support leg 26 is larger than a vertical span defined by an entry point 194 (FIG. 9) of the vertical channel 190 and the lower recessed walls 86 of the rearward projecting elements (or feet) 87.

The panels 22 are preferably made of a resilient material having elastic memory, such as plastic. Although it is preferable to manufacture the panels 22 from a resilient plastic material, any suitable material may be used. For example, the panels 22 may comprise frame members having an interior opening covered by netting, or the panels 22 may be manufactures by a clear vinyl material.

In accordance with the principles of the present invention, a preferred method of temporarily surrounding a playing area of a playing field with a containment wall comprises the steps of:

(a) interlocking a plurality of modular panels 22 together in sequential, end-to-end abutment, and arranging said panels such that they collectively surround a desired playing area 30 of the playing field, said modular panels 22 each comprising a back wall 22*b;*

(b) removably attaching support legs 26 at the back wall 22*b* of at least some of the panels 22, and arranging said support legs 26 such that they extend laterally outwardly from the panels 22 to lend structural support thereto;

(c) detaching the panels 22 from each other and removing them from the field.

The method above may be enhanced if step (a) further comprises interlocking together a plurality of panels 22 at least some of which have recessed side walls defining an enclosure 60 in the back wall 22*b* thereof, where the method further comprises the step of:

(d) pivoting the support legs 26 inwardly into the enclosure 60 of the back wall 22*b* into a storage position.

A still further enhancement of the method comprises the step of:

(e) stacking the panels 22 upon one another with the support legs 26 residing in the storage position in the enclosures 60 of the back wall 22*b*.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A modular containment wall for a sports area, comprising:

a plurality of interlockable panels for at least partially enclosing lateral bounds of the sports area, each panel having a first end wall and an opposing second end wall, said panels further comprising coupling means for coupling the first end wall of one of the panels with the second end wall of the adjacent panel in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the back wall includes a recess formed therein, said recess having a vertical span that is longer than the support leg, and wherein the upper and lower leg mount means comprise means for (i) movably attaching the support leg to the back wall and (ii) enabling movement of the support leg from a first, lateral position to a second, storage position such that said support leg resides in said recess when disposed in the second, storage position.

2. The modular containment wall as defined in claim 1, wherein the leg mount means comprises means for removably attaching the support leg to at least three different attachment sites on one of the panels.

3. The modular containment wall as defined in claim 1, wherein a horizontal cross section taken from the at least one support leg defines a first, elongate portion having a substantial rectangular shape and a second, end portion having a circular shape defining an outer diameter, wherein the first, elongate portion is narrower than said outer diameter.

4. The modular containment wall as defined in claim 3, wherein the back wall further includes at least one semi-cylindrical indentation formed in the recess thereof for receiving the second, end portion of the at least one support leg thereinto.

5. The modular containment wall as defined in claim 1, wherein the panels are hollow, with the front wall and back wall being disposed in a spaced-apart orientation.

6. The modular containment wall as defined in claim 5, wherein the panels further comprise internal bracing means for bracing the front wall and back wall with respect to each other.

7. The modular containment wall as defined in claim 6, wherein the internal bracing means comprises a plurality of spaced-apart brace members sandwiched between the front wall and back wall.

8. The modular containment wall as defined in claim 1, wherein the at least one leg includes a downward oriented anchor opening in a vertical plane of the at least one leg, said anchor opening being configured for insertion of an anchor member through the opening and into a subfloor or ground surface.

9. The modular containment wall as defined in claim 1, wherein the coupling means further comprises means for coupling the first end walls with the second end walls in a manner such that a substantially continuous surface is formed between adjacent panels.

10. The modular containment wall as defined in claim 1, wherein the coupling means comprises a plurality of projecting interlock members extending laterally outwardly from at least some of the end walls of the panels in a vertically spaced apart orientation.

11. The modular containment wall as defined in claim 10, wherein the projecting interlock members extend laterally outwardly from the first end walls of at least some of the panels, and wherein the coupling means further comprise recessed walls defining a plurality of enclosures in the second end walls of at least some of the panels for receiving the projecting interlock members into said enclosures.

12. The modular containment wall as defined in claim 1, wherein the lateral support member of the support leg is disposed in a horizontally extending orientation and at a common level with and laterally displaced from the bottom wall of the panel when the support leg is attached at the upper and lower leg mount means.

13. The modular containment wall as defined in claim 1, wherein the support leg is rotatably attachable at the upper and lower leg mount means.

14. The modular containment wall as defined in claim 1, wherein the coupling means further comprise means for intercoupling the panels and forming therewith a perimeter wall of a skating sports arena.

15. The modular containment wall as defined in claim 1, wherein each panel comprises a first end section, an opposing second end section, and an intermediate section, wherein the leg mount means comprises means for selectively and removably mounting the support leg at either the first end section, second end section, or intermediate section.

16. The modular containment wall as defined in claim 1, wherein the at least one support leg includes a plurality of downward projecting support elements alternating with spacial gaps therebetween.

17. The modular containment wall as defined in claim 1, wherein the at least one support leg further comprises a three-sided, substantially triangular-shaped member.

18. The modular containment wall as defined in claim 1, wherein the at least one support leg further comprises first, second and third support arms intercoupled in series to form a three-sided member defining a substantially triangular central opening.

19. The modular containment wall as defined in claim 1, wherein the support leg comprises a wall member having upright sections including upper and lower ends removably attachable to the upper and lower leg mount means, said wall member having a bottom wall horizontally positioned at a common level with and laterally displaced from the bottom wall of the panel.

20. The modular containment wall as defined in claim 1, further comprising:

a door member having upright sections including upper and lower ends rotatably attachable to the upper and lower leg mount means, said door member having a bottom wall horizontally positioned at a common level with and laterally displaced from the bottom wall of the panel.

21. The modular containment wall as defined in claim 1, wherein some of the panels define an arcuate shape sufficient in dimension and configuration to enable the panels to be sequentially intercoupled by the coupling means in an endless boundary enclosure surrounding the sports area, such that at least a first portion and a second portion of said boundary enclosure define a 90° angle therebetween.

22. The modular containment wall as defined in claim 1, wherein the top wall of at least some of the panels includes an elongate slot formed therein for receiving a backstop panel thereinto.

23. The modular containment wall as defined in claim 1, wherein the front wall comprises a lower portion having a plurality of outwardly projecting, spaced-apart ribs for enhanced resistance to external forces applied to said lower portion.

24. The modular containment wall as defined in claim 23, wherein the projecting ribs extend horizontally and thus in a first direction toward the first end wall and in a second direction toward the second end wall.

25. The modular containment wall as defined in claim 23, wherein the front wall further comprises an upper portion and wherein the lower portion is thicker than the upper portion for enhanced wear resistance.

26. The modular containment wall as defined in claim 1, wherein the front walls of at least some of the panels include a recessed portion formed therein configured and arranged for receiving an information plate into said recessed portion.

27. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the support leg is rotatably attachable at the upper and lower leg mount means, and wherein the front and back walls are spaced apart to form an interior void, said back wall including an exterior recess compartment formed therein configured in size and shape to receive the at least one support leg when said support leg is rotated toward the panel.

28. The modular containment wall as defined in claim 27, wherein the exterior compartment is recessed sufficiently deep to receive the at least one leg completely within the compartment when said leg is rotated to a storage position to facilitate a stable stacking configuration wherein the front wall of the panel rests flat against the back wall of an adjacent, stacked panel.

29. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the panels are hollow, with the front wall and back wall being disposed in a spaced-apart orientation;

wherein the panel comprises a fluidic inner layer disposed between the front wall and back wall.

30. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the panels are hollow, with the front wall and back wall being disposed in a spaced-apart orientation;

wherein the panels further comprise internal bracing means for bracing the front wall and back wall with respect to each other;

wherein the internal bracing means comprises a plurality of spaced-apart brace members sandwiched between the front wall and back wall;

wherein the brace members include throughpassages formed therein extending through the front wall and back wall.

31. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the support leg includes a throughpassage formed therein that is vertically disposed when the support leg is attached at the upper and lower leg mount means, said throughpassage having an upper opening and an opposing lower opening, said containment wall further comprising:

anchoring means for (i) inserting into the upper opening of the throughpassage, (ii) extending from the lower opening of the throughpassage, and (iii) anchoring the support leg to a support means.

32. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the coupling means comprises a plurality of projecting interlock members extending laterally outwardly from at least some of the end walls of the panels in a vertically spaced apart orientation;

wherein the projecting interlock members extend laterally outwardly from the first end walls of at least some of the panels, and wherein the coupling means further comprise recessed walls defining a plurality of enclosures in the second end walls of at least some of the panels for receiving the projecting interlock members into said enclosures;

wherein the projecting interlock members, the recessed walls defining the enclosures, and top walls of the panels have throughpassages formed therein, wherein the throughpassages formed in the projecting interlock members and recessed walls are disposed in substantial axial alignment with each other and with throughpassages in the top walls of the panels when the projecting interlock members are received into the enclosures such that the axially aligned throughpassages collectively define a single throughpassage for receiving a support rod therethrough.

33. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the bottom walls of at least some of the panels each have a plurality of bottom throughpassages formed therein, and wherein the top walls of at least some of the panels each have a plurality of top throughpassages formed therein that are disposed in substantial axial alignment with the throughpassages in the bottom walls.

34. The modular containment wall as defined in claim 33, further comprising:

support rods configured and dimensioned to extend simultaneously through the throughpassages of the top walls and bottom walls of the panels; and anchoring means for anchoring the support rods to ground or subflooring residing beneath the panels.

35. The modular containment wall as defined in claim 33, further comprising:

recessed walls defining an enclosure in the back wall, said recessed walls comprising an upper recessed wall and a lower recessed wall;

upper support channels sandwiched between the upper recessed wall and the top wall, said upper support channels defining the top throughpassages; and lower support channels sandwiched between the lower recessed wall and the bottom wall, said lower support channels defining the bottom throughpassages.

36. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

means removably attachable to the panel for performing at least one function selected from the group consisting of:

(i) supporting people in a sitting position;

(ii) forming a wall extending laterally outward from the panel;

(iii) forming a door; and (iv) forming a room.

37. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the at least one support leg includes a plurality of downward projecting support elements alternating with spacial gaps therebetween;

wherein the upper and lower leg mount means comprise means for (i) movably attaching the support leg to the back wall and (ii) enabling movement of the support leg from a first, lateral position to a second, storage position;

wherein the bottom wall of the panel is configured at a rearward section with a plurality of rearward projecting elements alternating with spacial gaps therebetween, said spacial gaps being aligned to receive the downward projecting support elements of the lateral support member when the leg is in the storage position.

38. A containment wall as defined in claim 27, wherein at least one of the downward projecting support elements of the support leg has a support surface at a common level with the bottom wall of the panel to provide additional support contact for the at least one support leg at a ground or floor surface.

39. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the at least one support leg further comprises first, second and third support arms intercoupled in series to form a three-sided member defining a substantially triangular central opening;

wherein the first support arm is vertically disposed when the support leg is attached at the upper and lower leg mount means, said vertically disposed support arm having an upper nub and an opposing lower nub formed thereon for insertion into the upper and lower leg mount means, respectively.

40. The modular containment wall as defined in claim 39, wherein the second and third support arms are horizontally and diagonally disposed, respectively, when the support leg is attached at the upper and lower leg mount means, and wherein the support leg further comprises a plurality of downward projecting, horizontally-spaced support elements disposed on the second support arm, and wherein the at least one support leg further comprises a throughpassage formed therein that is vertically disposed when the support leg is attached at the upper and lower leg mount means, said throughpassage having an upper opening and an opposing lower opening, said containment wall further comprising:

anchoring means for (i) inserting into the upper opening of the throughpassage, (ii) extending from the lower opening of the throughpassage, and (iii) anchoring the support leg to a support means.

41. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

a seat member having a horizontal seat surface;

a seat support member coupled to the seat member and having upright sections including upper and lower ends removably attachable to the upper and lower leg mount means, said seat support member having a lateral support member horizontally positioned at a common level with and laterally displaced from the bottom wall of the panel to provide additional stability to the panels and loading support for the seat member.

42. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the support leg includes an upper, downwardly extending nub and a lower, upwardly extending nub disposed on the upper and lower ends, respectively, said upper and lower nubs being positioned, aligned and arranged for simultaneously extending into the upper and lower leg mount means, respectively.

43. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the upper and lower leg mount means comprise a downwardly extending nub and an upwardly extending nub, respectively, and wherein the upper and lower ends of the support leg each include receiving slots being positioned, aligned and arranged for simultaneously receiving the downwardly and upwardly extending nubs, respectively.

44. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the back wall of at least some of the panels comprises an upper, rearwardly extending ledge having an underside, and wherein the upper leg mount means comprises a lateral entry slot formed in the underside of the ledge, said entry slot extending toward the front wall and having an upper side.

45. The modular containment wall as defined in claim 44, wherein the upper leg mount means further comprises vertical side walls defining an upper vertical channel disposed in communication with the entry slot, and wherein the upper side of the lateral entry slot defines an acute angle with respect to the vertical side walls.

46. The modular containment wall as defined in claim 44, wherein the lower leg mount means comprises a plurality of feet having lower vertical channels formed therein.

47. The modular containment wall as defined in claim 46, wherein the upper vertical channels of the upper leg mount means are disposed in a substantial coaxial orientation with respect to the lower vertical channels of the lower leg mount means.

48. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the top wall of at least some of the panels includes an elongate slot formed therein for receiving a backstop panel thereinto;

wherein the top walls of at least some of the panels each have a plurality of top throughpassages formed therein for receiving support rods therethrough, said top throughpassages having inner diameters, wherein the elongate slot defines a rear plane and wherein a gap space resides between said rear plane and the inner diameters of the upper holes, such that when support rods are disposed to extend upwardly from the upper holes and when a backstop panel resides in said elongate slot, said backstop panel and said support rods define gap spaces therebetween.

49. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein the top wall of at least some of the panels includes an elongate slot formed therein for receiving a backstop panel thereinto;

wherein the top walls of at least some of the panels each have a plurality of top throughpassages formed therein for receiving support rods therethrough, and wherein the slot intercepts the top throughpassages and is thereby disposed in communication with said top throughpassages.

50. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein a horizontal cross section taken from the at least one support leg defines a first, elongate portion having a substantial rectangular shape and a second, end portion having a circular shape defining an outer diameter, wherein the first, elongate portion is narrower than said outer diameter.

51. The modular containment wall as defined in claim 50, wherein the back wall includes at least one semi-cylindrical indentation formed therein for receiving the second, end portion of the at least one support leg thereinto.

52. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel; and at least one support leg having upper and lower ends removably attachable at the upper and lower leg mount means, said support leg having a lateral support member;

wherein at least some of the panels each comprise a lower front portion having a lateral slot formed therein for receiving an edge of a tile thereinto, said lateral slot being defined by a portion of the bottom wall.

53. The modular containment wall as defined in claim 52, wherein the portion of the bottom wall defining the lateral slot is coupled to the front wall such that said front wall resides above said lateral slot and thus out of direct contact with the sports area.

54. A modular containment wall for a sports area, comprising:

a plurality of interlockable panels for at least partially enclosing lateral bounds of the sports area, each panel having a first end wall and an opposing second end wall, said panels further comprising coupling means for coupling the first end walls with the second end walls in an end-to-end, abutting manner;

said panels having top and bottom walls coupled between the opposing first and second end walls to form a substantially continuous panel perimeter;

said panels having front and back walls coupled at opposing front and back edges of the panel perimeter;

a plurality of pairs of vertically spaced upper and lower leg mount means formed respectively at upper and lower locations on the panels for enabling removable attachment of a support leg at the back wall of the panel;

at least one support leg having upper and lower ends removably attachable at the upper and lower leg mount means, said support leg having a lateral support member;

wherein the leg mount means comprises means for removably attaching the support leg to at least three different attachment sites on one of the panels;

wherein the back wall includes a recess formed therein, said recess having a vertical span that is longer than the support leg, and wherein the upper and lower leg mount means comprise means for (i) movably attaching the support leg to the back wall and (ii) enabling movement of the support leg from a first, lateral position to a second, storage position such that said support leg resides in said recess when disposed in the second, storage position;

wherein the panels are hollow, with the front wall and back wall being disposed in a spaced-apart orientation;

wherein the panels further comprise internal bracing means for bracing the front wall and back wall with respect to each other, comprising a plurality of spaced-apart brace members sandwiched between the front wall and back wall, wherein the brace members include throughpassages formed therein extending through the front wall and back wall;

wherein the coupling means further comprises means for coupling the first end walls with the second end walls in a manner such that a substantially continuous surface is formed between adjacent panels;

wherein the coupling means comprises a plurality of projecting interlock members extending laterally outwardly from at least some of the end walls of the panels in a vertically spaced apart orientation;

wherein the projecting interlock members extend laterally outwardly from the first end walls of at least some of the panels, and wherein the coupling means further comprise recessed walls defining a plurality of enclosures in the second end walls of at least some of the panels for receiving the projecting interlock members into said enclosures;

wherein the projecting interlock members, the recessed walls defining the enclosures, and top walls of the panels have throughpassages formed therein, wherein the throughpassages formed in the projecting interlock members and recessed walls are disposed in substantial axial alignment with each other and with throughpassages in the top walls of the panels when the projecting interlock members are received into the enclosures such that the axially aligned throughpassages collectively define a single throughpassage for receiving a support rod therethrough;

wherein the bottom walls of at least some of the panels each have a plurality of bottom throughpassages formed therein, and wherein the top walls of at least some of the panels each have a plurality of top throughpassages formed therein that are disposed in substantial axial alignment with the throughpassages in the bottom walls;

wherein the upper and lower leg mount means comprise means for (i) movably attaching the support leg to the back wall and (ii) enabling movement of the support leg from a first, lateral position to a second, storage position;

wherein the bottom wall of the panel is configured at a rearward section with a plurality of rearward projecting elements alternating with spacial gaps therebetween, the spacial gaps of the lateral support member on the leg being aligned to receive the downward projecting support elements of the lateral support member when the leg is in the storage position;

wherein the back wall of at least some of the panels comprises an upper, rearwardly extending ledge having an underside, and wherein the upper leg mount means comprises a lateral channel formed in the underside of the ledge, said lateral channel extending toward the front wall and having an upper side;

wherein the upper leg mount means further comprises vertical side walls defining an upper vertical channel disposed in communication with the lateral channel, and wherein the upper side of the lateral channel defines an acute angle with respect to the vertical side walls;

wherein some of the panels define an arcuate shape sufficient in dimension and configuration to enable the panels to be sequentially intercoupled by the coupling means in an endless boundary enclosure surrounding the sports area;

wherein the top wall of at least some of the panels includes an elongate slot formed therein for receiving a backstop panel thereinto.

55. The modular containment wall as defined in claim 54, wherein a horizontal cross section taken from the at least one support leg defines a first, elongate portion having a substantial rectangular shape and a second, end portion having a circular shape defining an outer diameter, wherein the first, elongate portion is narrower than said outer diameter, and wherein the back wall includes at least one semi-cylindrical indentation formed therein for receiving the second, end portion of the at least one support leg thereinto.

56. The modular containment wall as defined in claim 54, wherein at least some of the panels each comprise a lower front portion having a lateral slot formed therein for receiving an edge of a tile thereinto, said lateral slot being defined by a portion of the bottom wall.

57. The modular containment wall as defined in claim 56, wherein the portion of the bottom wall defining the lateral slot is coupled to the front wall such that said front wall resides above said lateral slot and thus out of direct contact with the sports area.

* * * * *